US010464336B2

(12) United States Patent
Atsumi

(10) Patent No.: US 10,464,336 B2
(45) Date of Patent: Nov. 5, 2019

(54) DIAPHRAGM PUMP, INK SUPPLY SYSTEM, AND INKJET PRINTER

(71) Applicant: Roland DG Corporation, Hamamatsu-shi, Shizuoka (JP)

(72) Inventor: Hidetoshi Atsumi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/040,568

(22) Filed: Jul. 20, 2018

(65) Prior Publication Data

US 2019/0023021 A1 Jan. 24, 2019

(30) Foreign Application Priority Data

Jul. 24, 2017 (JP) ..... 2017-142501

(51) Int. Cl.
*B41J 2/175* (2006.01)
*F04B 43/02* (2006.01)

(52) U.S. Cl.
CPC ..... *B41J 2/17596* (2013.01); *B41J 2/17553* (2013.01); *F04B 43/02* (2013.01)

(58) Field of Classification Search
CPC ..... B41J 2/17596; B41J 2/16523; B41J 2/16532; B41J 2/16508; B41J 2/1721; B41J 2/18; B41J 2/175; B41J 2/17553; F04B 43/04; F04B 43/02; F05C 2251/04; F05C 2253/20; F05C 2251/02; F05C 2253/04
See application file for complete search history.

(56) References Cited

U.S. PATENT DOCUMENTS 5,217,797 A * 6/1993 Knox ..... B29C 70/086 428/167
5,374,473 A 12/1994 Knox et al.
5,560,279 A * 10/1996 Connors ..... F04B 43/009 417/63
6,179,406 B1 * 1/2001 Ito ..... B41J 2/1707 347/35
6,435,844 B1 * 8/2002 Fukami ..... F04B 43/0054 417/395

FOREIGN PATENT DOCUMENTS

CN 201606228 U 10/2010
JP 08-505094 A 6/1996
JP 2009-047121 A 3/2009

* cited by examiner

*Primary Examiner* — Henok D Legesse
(74) *Attorney, Agent, or Firm* — Keating & Bennett, LLP

(57) ABSTRACT

A diaphragm pump includes a pump chamber, a diaphragm, and a diaphragm deformer. The pump chamber is box-shaped and includes at least an inlet opening, an outlet opening, and a diaphragm attaching opening. The pump chamber is provided with an inner space. A diaphragm is made of an elastically deformable material, and is provided in the pump chamber so as to cover the diaphragm attaching opening. The diaphragm deformer elastically deforms the diaphragm to change a capacity of the inner space. The outlet opening is located at a highest position in the inner space of the pump chamber.

10 Claims, 5 Drawing Sheets

DIAPHRAGM PUMP, INK SUPPLY SYSTEM, AND INKJET PRINTER

CROSS REFERENCE TO RELATED APPLICATIONS

This application claims the benefit of priority to Japanese Patent Application No. 2017-142501 filed on Jul. 24, 2017. The entire contents of this application are hereby incorporated herein by reference.

BACKGROUND OF THE INVENTION

1. Field of the Invention

The present invention relates to a diaphragm pump, an ink supply system including the diaphragm pump, and an inkjet printer including the ink supply system.

2. Description of the Related Art

Conventionally, a diaphragm pump is known as a small pump. For example, Japanese Laid-Open Patent Publication No. 2009-47121 discloses a small diaphragm pump including a molded valve providing both of a high sealing function and a high flow rate precision. Such a diaphragm pump is used in various devices including a mechanism that pumps out a liquid, and is used in an inkjet printer. In the inkjet printer, a diaphragm pump is used as, for example, a pump that supplies ink from an ink tank to an ink head.

In general, a capacity-changeable pump such as a diaphragm pump or the like has a liquid pump-out capability (or injection capability) thereof decreased if the liquid to be pumped out is contaminated with gas. Such a capacity-changeable pump pumps out a liquid by changing the capacity of an inner space of a pump chamber. If the liquid to be pumped out is contaminated with gas, the change in the capacity of the pump chamber is partially absorbed by the change in the volume of the gas, and as a result, the amount of the liquid that can be pumped out is decreased. The capacity-changeable pump is provided based on an assumption that a non-compressible fluid such as water or ink is to be pumped out. If the non-compressible fluid is contaminated with a compressible fluid such as air, the liquid pump-out capability is decreased by a level corresponding to the change in the volume of the compressible fluid. In the case where the pump chamber is contaminated with a certain amount of air or the like, the pump may not be capable of pumping out the fluid. Herein, the "liquid pump-out capability" refers to the capability of a pump of pumping out a liquid (encompassing ink).

As described above, the diaphragm pump is used in an ink supply system of an inkjet printer. In the ink supply system of the inkjet printer, air absorbed through a nozzle of an ink head may possibly enter the diaphragm pump. A reason for this is that ink is kept at a negative pressure so as not to drip from the nozzle. In the ink supply system of the ink jet printer, it is fully possible that air enters the inside of the diaphragm pump and thus decreases the liquid pump-out capability of the diaphragm pump. In addition to the entrance of the air into the liquid, a decrease in the rigidity of the diaphragm caused by deterioration thereof may decrease the liquid pump-out capability of the diaphragm pump.

SUMMARY OF THE INVENTION

Preferred embodiments of the present invention provide diaphragm pumps that do not easily allow the liquid pump-out capability thereof to be decreased. Other preferred embodiments of the present invention provide ink supply systems and inkjet printers including such diaphragm pumps.

A diaphragm pump according to a preferred embodiment of the present invention includes a pump chamber, a diaphragm, and a diaphragm deformer. The pump chamber is shaped like a box provided with at least an inlet opening allowing a liquid to flow into the pump chamber therethrough from outside, an outlet opening allowing the liquid to flow out of the pump chamber therethrough, and a diaphragm attaching opening. The pump chamber is provided with an inner space. The diaphragm is preferably made of an elastically deformable material, and is provided in the pump chamber so as to cover the diaphragm attaching opening. The diaphragm deformer is provided outside the pump chamber and coupled with the diaphragm, and elastically deforms the diaphragm to change a capacity of the inner space. The outlet opening is located at the highest position in the inner space of the pump chamber.

In the above-described diaphragm pump, air that has entered the pump chamber through the inlet opening is concentrated in the vicinity of the outlet opening, which is provided at the highest position in the pump chamber. The air is immediately discharged from the pump chamber by the driving of the diaphragm pump, and thus does not influence the liquid pump-out capability of the diaphragm pump almost at all. Thus, the above-described diaphragm pump is able to keep pumping out the liquid without having the liquid pump-out capability decreased almost at all even under the condition of use in which the liquid is contaminated with air.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of ink supply systems each including a diaphragm pump, and inkjet printers including the ink supply systems according to preferred embodiments of the present invention will be described with reference to the drawings. The preferred embodiments described below are not intended to specifically limit the present invention. Components and portions that have the same functions will bear the same reference signs, and overlapping descriptions will be omitted or simplified.

Figure 1:
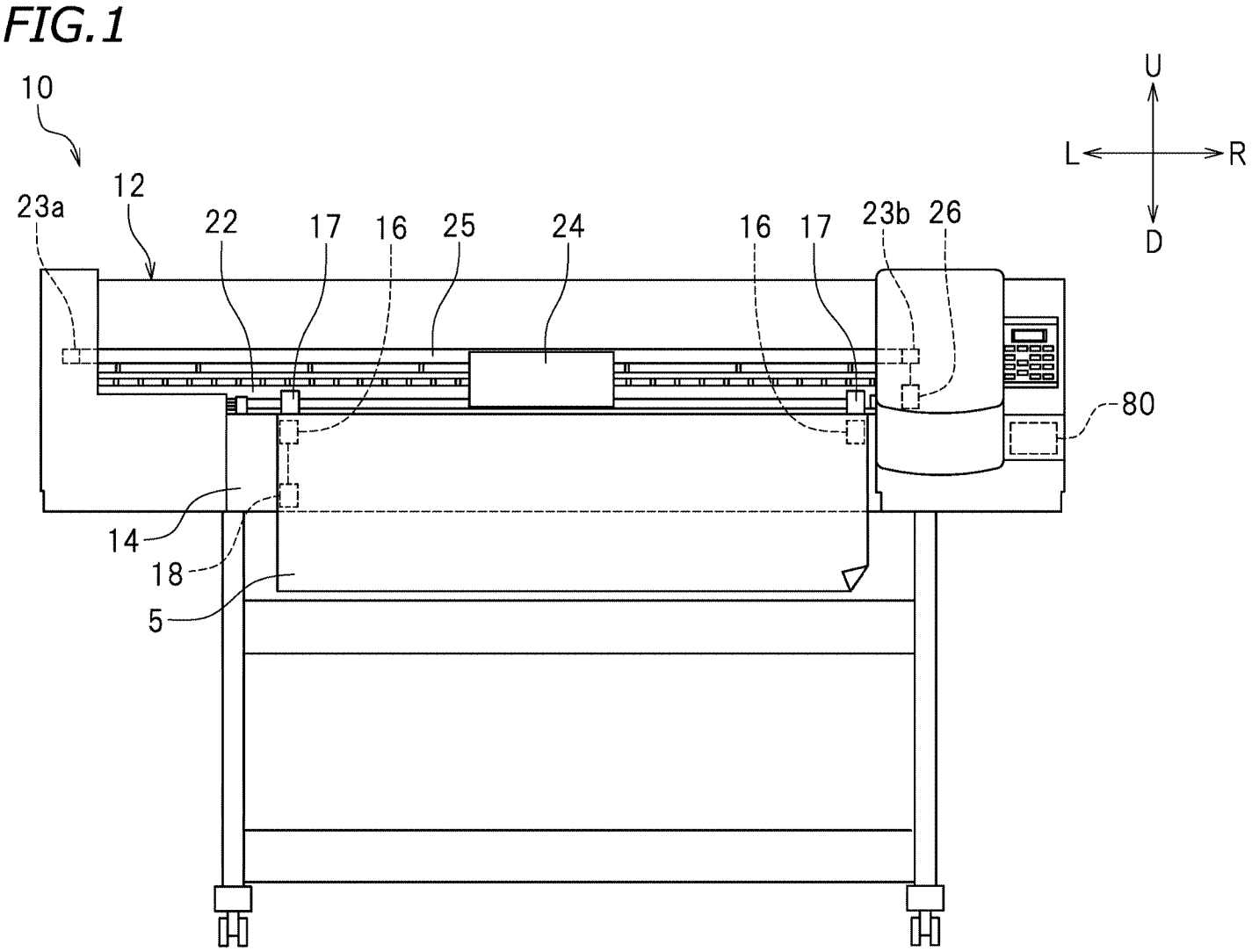
FIG. 1 is a front view of a printer according to a preferred embodiment of the present invention.

FIG. 1 is a front view of an inkjet printer (hereinafter, referred to as a "printer") 10 according to a preferred embodiment. In the following description, letters F, Rr, L, R, U and D in the drawings respectively refer to "front", "rear", "left", "right", "up" and "down" regarding the printer 10 seen from a front side thereof. These directions are provided merely for the sake of convenience, and do not limit the manner of installation of the printer 10 in any way.

As shown in FIG. 1, the printer 10 performs printing on a recording medium 5. In this preferred embodiment, the recording medium 5 is roll-type recording paper. The recording medium 5 is not limited to the roll-type recording paper. The recording medium 5 may be, for example, a resin sheet or the like. The recording medium 5 is not limited to a flexible sheet, and may be a hard medium such as a glass plate or the like. There is no specific limitation on the material of the recording medium 5.

In this preferred embodiment, the printer 10 includes a printer main body 12 and a guide rail 22 secured to the printer main body 12. The guide rail 22 extends in a left-right direction, and is engaged with a carriage 24. The carriage 24 is slidable leftward and rightward along the guide rail 22. An endless belt is secured to the carriage 24. Pulleys 23*a* and 23*b* are respectively provided at a left end and a right end of the guide rail 22, and a carriage motor 26 is connected with the right pulley 23*b*. The pulley 23*b* connected with the carriage motor 26 is drivable by the carriage motor 26 to be rotated. The endless belt 25 is wrapped along, and extends between, the pulleys 23*a* and 23*b*. When the carriage motor 26 is driven to rotate the pulley 23*b* and thus to run the endless belt 25, the carriage 24 moves in the left-right direction. In this manner, the carriage 24 is movable in the left-right direction along the guide rail 22.

The printer main body 12 includes a platen 14, on which the recording medium 5 may be placed. The platen 14 supports the recording medium 5 while printing is performed on the recording medium 5. The platen 14 is provided with grit rollers 16 and pinch rollers 17. The pinch rollers 17 acting as upper rollers and the grit rollers 16 acting as lower rollers form pairs of rollers. The grit rollers 16 are coupled with a feed motor 18, and are driven to rotate by the feed motor 18. When the grit rollers 16 are rotated in the state where the recording medium 5 is held between the grit rollers 16 and the pinch rollers 17, the recording medium 5 is fed in a front-rear direction.

Figure 2:
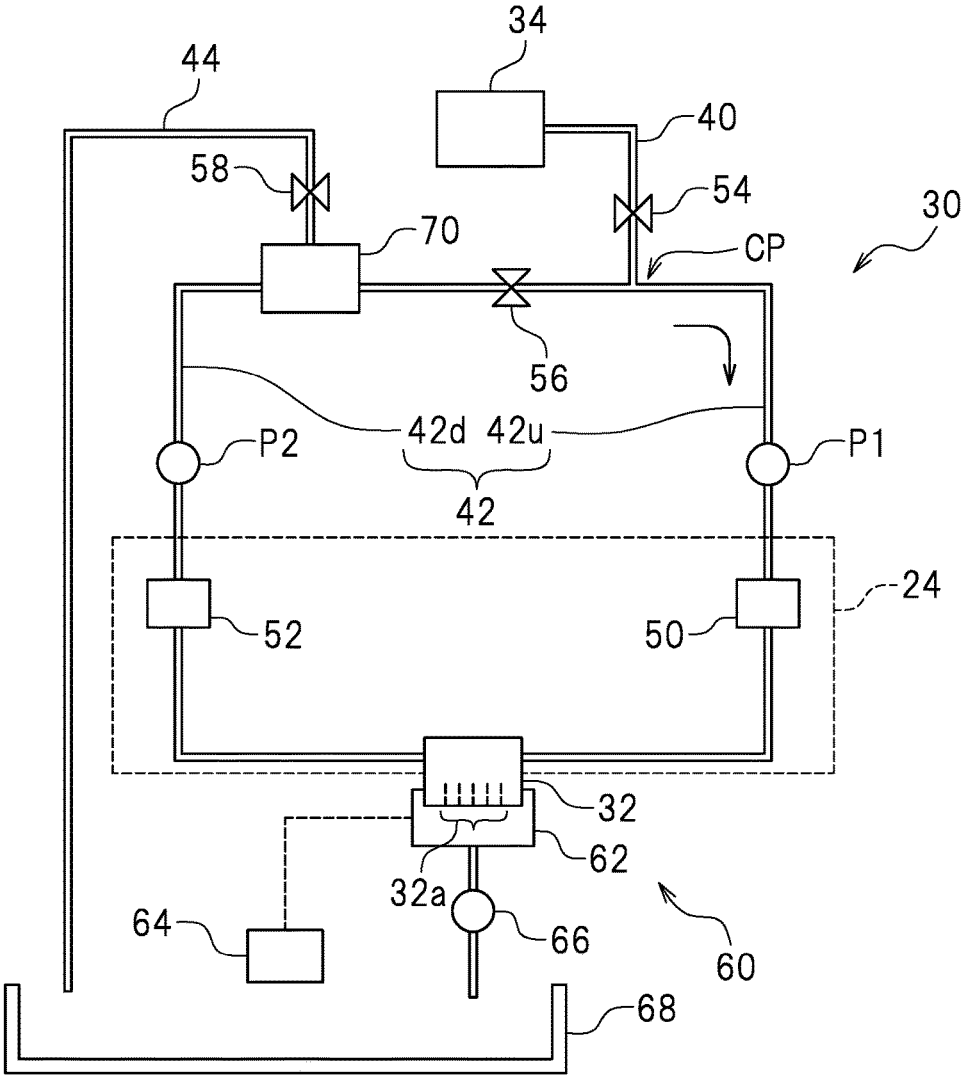
FIG. 2 is a schematic view showing an ink supply system.

In this preferred embodiment, the printer 10 includes a plurality of ink supply systems. FIG. 2 is a schematic view showing an ink supply system 30 and a capping system 60. The ink supply system 30 supplies ink from an ink tank 34 toward an ink head 32. One ink supply system 30 is provided for one ink head 32. One ink supply system 30 includes one ink tank 34. In this preferred embodiment, the printer 10 includes a plurality of the ink heads 32 and the same number of ink supply systems 30 as that of the ink heads 32. There is no specific limitation on the number of the ink heads 32 and the ink supply systems 30. The plurality of ink supply systems 30 may have the same structure as each other, for example. Thus, a structure of one ink supply system 30 will be described in detail below.

As shown in FIG. 2, the ink supply system 30 in this preferred embodiment includes the ink head 32, the ink tank 34, an introduction flow path 40, an upstream flow path 42*u*, a downstream flow path 42*d*, an upstream pump P1, a downstream pump P2, an upstream damper 50, a downstream dumper 52, an introduction valve 54, a circulation valve 56, and an air trap 70. The ink supply system 30 in this preferred embodiment circulates ink in a flow path. In the following, a ring-shaped flow path including the upstream flow path 42*u* and the downstream flow path 42*d* may be referred to as a "circulation flow path 42".

As shown in FIG. 2, the ink head 32 is mounted on the carriage 24. The ink head 32 is movable in the left-right direction along the guide rail 22 while being on the carriage 24. The ink head 32 injects ink toward the recording medium 5 placed on the platen 14. Nozzles 32*a* through which ink may be injected are provided in a bottom surface of the ink head 32. Actuators (not shown) each including a piezoelectric element or the like are provided inside each ink head 32. The actuators are electrically connected with a controller 80 (see FIG. 1). The actuators are controlled by the controller 80. The actuators are driven, so that the ink is injected through the nozzles 32*a* of the ink head 32 toward the recording medium 5.

The ink tank 34 stores ink. The ink tank 34 is detachably provided on the printer main body 12. There is no specific limitation on the position of the ink tank 34. For example, the ink tank 34 may be detachably provided on the carriage 24. One ink tank 34 stores, for example, process color ink such as cyan ink, magenta ink, yellow ink, light cyan ink, light magenta ink, black ink or the like, or special color ink such as white ink, metallic ink, clear ink or the like. There is no limitation on the type of ink to be stored in the ink tank 34.

The introduction flow path 40 supplies the ink stored in the ink tank 34 to the upstream flow path 42*u*. The introduction flow path 40 includes one end connected with the ink tank 34 and the other end connected with upstream flow path 42*u*. The introduction valve 54 is provided at an intermediate position of the introduction flow path 40. The introduction valve 54 opens or closes the introduction flow path 40.

The circulation flow path 42 is a ring-shaped flow path in which ink may be circulated, and includes the upstream flow path 42*u* and the downstream flow path 42*d*. The upstream flow path 42*u* includes one end connected with the introduction flow path 40 at a connection portion CP and includes the other end connected with the ink head 32. The upstream flow path 42*u* supplies the ink to the ink head 32. The arrow in FIG. 2 shows the direction in which the ink flows. The ink flows in the upstream flow path 42*u* only in one direction as represented by the arrow in FIG. 2. In the upstream flow path 42*u*, the upstream pump P1 is located immediately downstream with respect to the connection portion CP. The upstream damper 50 is provided downstream with respect to the upstream pump P1. The ink head 32 is provided downstream with respect to the upstream damper 50. The downstream flow path 42*d* is connected with the upstream flow path 42*u*, at a position downstream with respect to the ink head 32. The downstream flow path 42*d* includes an upstream end connected with the ink head 32 and a downstream end connected with the connection portion CP, at which the introduction flow path 40 and the upstream flow path 42*u* are connected with each other. The introduction flow path 40, the upstream flow path 42*u* and the downstream flow path 42*d* are branched from each other at the connection portion CP. The downstream flow path 42*d* is provided with the downstream damper 52, the downstream pump P2, the air trap 70 and the circulation valve 56 sequentially from the upstream end thereof. The one-direction flow of the ink in the circulation flow path 42 including the upstream flow path 42*u* and the downstream flow path 42*d* is created by the upstream pump P1 and the downstream pump P2. The circulation valve 56 opens or closes the circulation flow path 42. While the circulation valve 56 is opened, the circulation flow path 42 is a flow path allowing the ink to circulate. By contrast, while the circulation valve 56 is closed, the circulation flow path 42 provides a one-direction flow path from the connection portion CP to the air trap 70 via the ink head 32.

There is no limitation on the type or material of the introduction flow path 40, the upstream flow path 42*u* or the downstream flow path 42*d*. The introduction flow path 40, the upstream flow path 42*u* and the downstream flow path 42*d* are, for example, each a flexible tube.

The upstream pump P1 and the downstream pump P2 supply ink. The upstream pump P1 supplies the ink toward the ink head 32, and adjusts the flow rate of the ink to be supplied to the ink head 32. The downstream pump P2 recovers the ink from the ink head 32, and adjusts the flow rate of the ink to flow out from the ink head 32. The upstream pump P1 adjusts the flow rate of the ink to be supplied, so that the pressure of the ink in the upstream flow path 42*u* is adjusted. The downstream pump P2 adjusts the flow rate of the ink to be returned, so that the pressure of the ink in the downstream flow path 42*d* is adjusted. The pressure of the ink in the upstream flow path 42*u* and the downstream flow path 42*d* is adjusted, so that the pressure of the ink in the ink head 32 is adjusted. In this preferred embodiment, the upstream pump P1 and the downstream pump P2 are the same type of diaphragm pumps. An internal structure of the upstream pump P1 and the downstream pump P2 will be described below.

The upstream damper 50 and the downstream damper 52 are mounted on the carriage 24. The upstream damper 50 and the downstream damper 52 alleviate a change in the pressure of the ink to stabilize an ink injection operation of the ink head 32 and also to adjust the pressure of the ink in the ink head 32 to a desired level. The upstream damper 50 detects the pressure of the ink flowing into the upstream damper 50. Driving of the upstream pump P1 is controlled based on the detection result of the pressure provided by the upstream damper 50. The downstream damper 52 detects the pressure of the ink flowing into the downstream damper 52. Driving of the downstream pump P2 is controlled based on the detection result of the pressure provided by the downstream damper 52.

In the downstream flow path 42*d*, the air trap 70 is provided downstream with respect to the downstream pump P2. The air trap 70 traps air contained in the ink. The air in the ink enters mainly from the ink head 32. The air trap 70 is, for example, a gas-liquid separator. The air trap 70 is connected with a discharge flow path 44. A discharge valve 58 is provided at an intermediate position of the discharge flow path 44. The discharge valve 58 opens or closes the discharge flow path 44. The discharge flow path 44 is connected with a waste liquid tank at a position beyond the discharge valve 58. There is no limitation on the material or the type of the discharge flow path 44. The discharge flow path 44 is also, for example, a tube.

The printer 10 in this preferred embodiment includes the capping system 60. The capping system 60 includes a cap 62, a cap conveyor 64, and a suction pump 66. The cap 62 and the suction pump 66 are located at a home position (not shown) at a right end of the guide rail 22 (see FIG. 1). At the home position, the ink head 32 waits at a printing-wait time, namely, while no printing is performed. The cap 62 prevents the nozzles 32*a* of the ink head from being clogged as a result of the ink attached to the nozzles 32*a* being cured. The cap 62 is attached to the ink head so as to cover the nozzles 32*a* of the ink head 32 at the printing-wait time. The cap conveyor 64 is connected with the cap 62. At the home position, the cap conveyor 64 moves the cap 62 in an up-down direction toward, and away from, the surface of the ink head 32 where the nozzles 32*a* are located. There is no specific limitation on the structure of the cap conveyor 64. The cap conveyor 64 includes, for example, a driving motor. The cap conveyor 64 drives the driving motor to move the cap 62 in the up-down direction.

The suction pump 66 absorbs the ink in the ink head 32 while the cap 62 is attached to the ink head 32. The absorption is provided in order to prevent the nozzles 32*a* of the ink head 32 from being clogged. The suction pump 66 is provided with a suction opening connected with the cap 62 and is provided with a discharge opening connected with the waste liquid tank 68. The ink absorbed by the suction pump 66 is discharged to the waste liquid tank 68.

The controller 80 is configured or programmed to control an operation of each of the components of the printer 10. The controller 80 is operatively connected with, and thus controls operations of, the carriage motor 26, the feed motor 18, the actuators built in the ink head 32, the upstream pump P1, the downstream pump P2, the introduction valve 54, the circulation valve 56, the discharge valve 58, the driving motor of the cap conveyor 64, and the suction pump 66. The controller 80 is connected with the upstream damper 50 and the downstream damper 52, and receives signals sent from the upstream damper 50 and the downstream damper 52. There is no specific limitation on the structure of the controller 80. The controller 80 is, for example, a computer, and may include a central processing unit (hereinafter, referred to as a "CPU"), a ROM having a program(s) executable by the CPU stored thereon, a RAM and the like. Each of the components of the controller 80 may be a processor or a circuit.

In a printing-wait state, the controller 80 controls the cap conveyor 64 to attach the cap 62 to the ink head 32. The controller 80 controls the upstream pump P1 and the downstream pump P2 to circulate the ink in the circulation flow path 42. In the case where ink containing a pigment or the like is used, the ink is circulated as described above in order to prevent the pigment or the like from precipitating in the ink. At the same time, the controller 80 controls the pressure of the ink in the upstream flow path 42*u* and the downstream flow path 42*d* to a predetermined level, so that the pressure of the ink in the ink head 32 is controlled to a level within a predetermined range. The pressure of the ink in the ink head 32 in the printing-wait state is controlled to a level at which the ink is allowed to be injected but is not dripped from the nozzles 32*a*. Such a pressure is, for example, a negative pressure of about −1 kPa by the gauge pressure.

For performing the printing, the cap 62 is detached from the ink head 32, and the ink head 32 is driven by the carriage motor 26 to move from the home position onto the platen 14. The ink head 32 is scanned in the left-right direction together with the carriage 24 while injecting ink toward the recording medium 5 placed on the platen 14. The timing at which ink is injected from the nozzles 32*a* and the scanning of the carriage 24 are controlled in association with each other. Thus, the printing is performed for one printing line. Then, the recording medium 5 is fed forward by the grit rollers 16 coupled with the feed motor 18, and the printing is performed at the next position.

The ink supply system 30 in this preferred embodiment is able to discharge the ink in the circulation flow path 42. For discharging the ink, the controller 80 closes the circulation valve 56. The controller 80 opens the introduction valve 54 and the discharge valve 58. Such an operation on the valves provides a flow path from the ink tank 34 to the discharge flow path 44 and the waste liquid tank 68 via the introduction flow path 40, the upstream flow path 42*u*, the ink head 32, the downstream flow path 42*d* and the air trap 70. The controller 80 drives the upstream pump P1 and the downstream pump P2 to pump out the ink in the circulation flow path 42 toward the waste liquid tank 68. The pumped-out ink is discharged to the waste liquid tank 68. Such discharge of the ink is performed when the ink is to be exchanged, or when the printer 10 is to be moved.

The ink supply system 30 in this preferred embodiment is capable of absorbing the ink from the nozzles 32*a* toward the outside of the ink head 32. Before the ink is absorbed, the cap 62 is attached to the ink head 32. The suction pump 66 absorbs the ink from the nozzles 32*a* of the ink head 32 via the cap 62.

Figure 3:
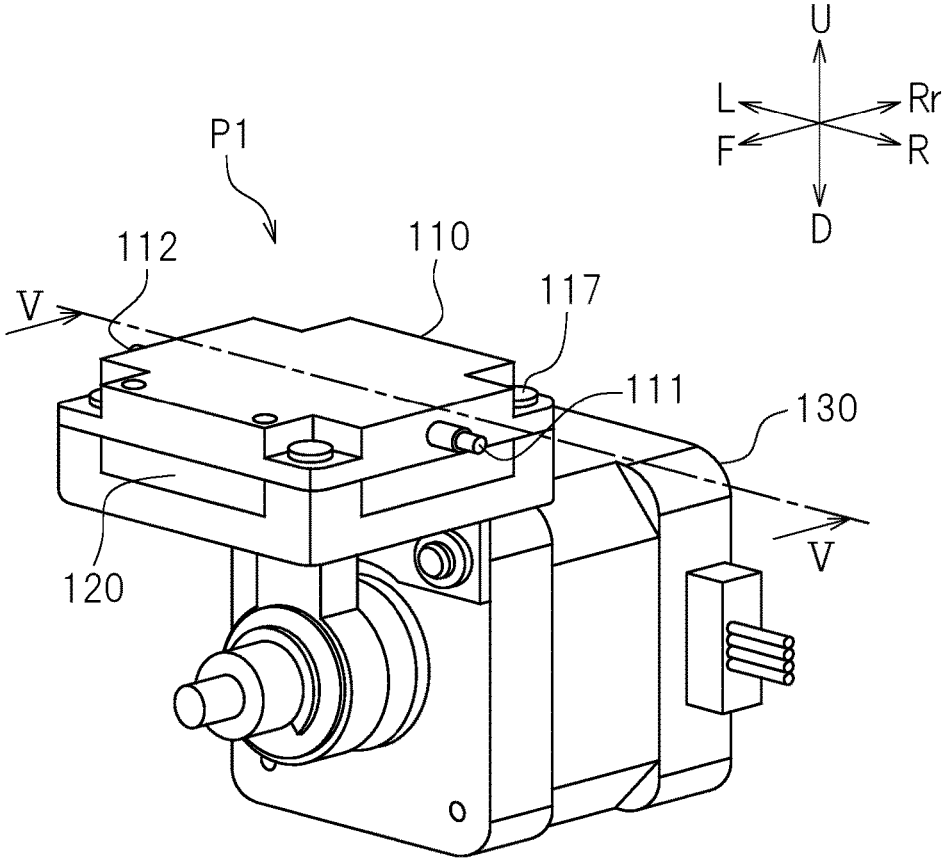
FIG. 3 is a perspective view of an upstream pump.
Figure 4:
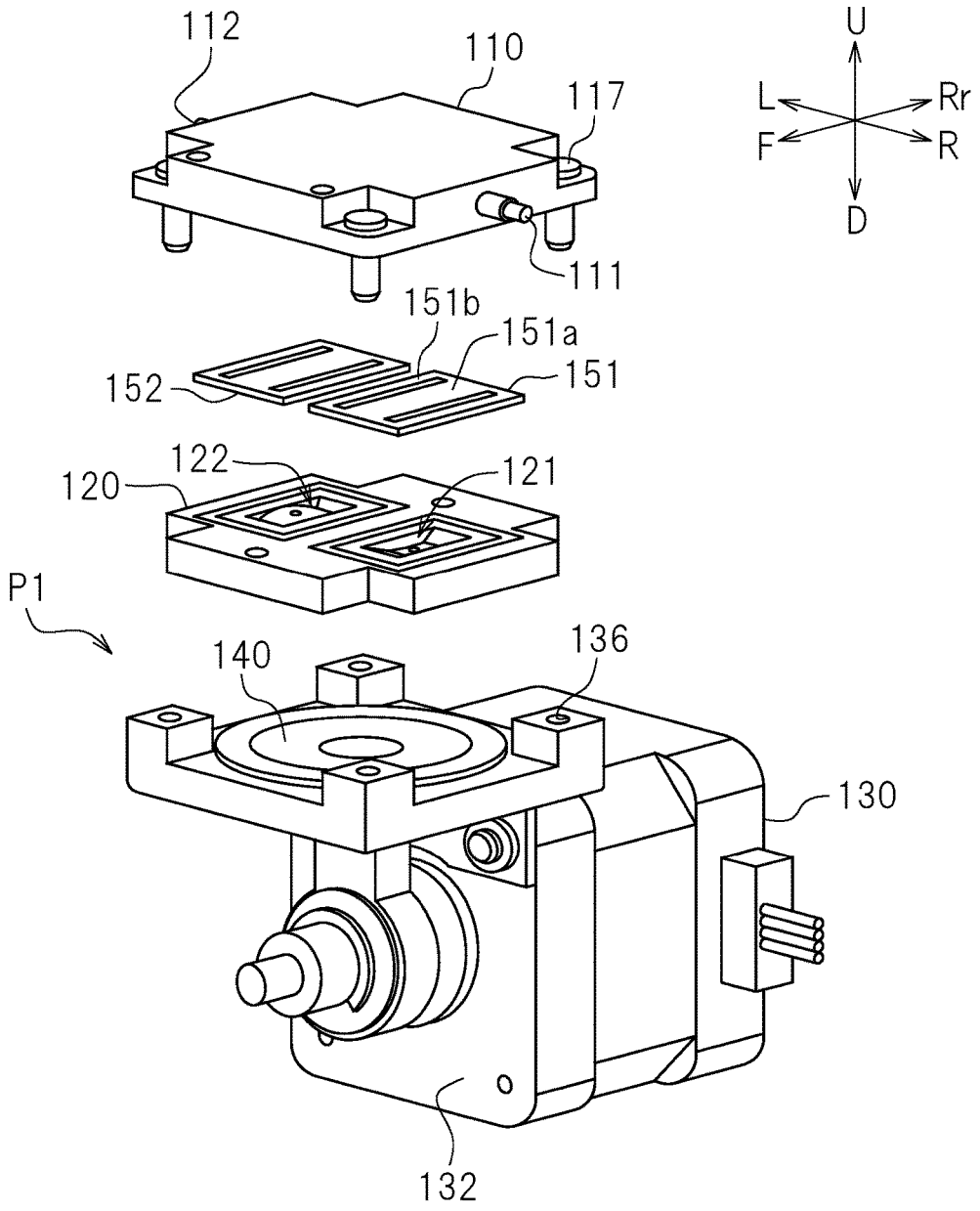
FIG. 4 is an exploded perspective view of the upstream pump that shows a first member, a second member and a third member as being separate from each other.

The upstream pump P1 and the downstream pump P2 circulate the ink in the circulation flow path 42. As described above, in this preferred embodiment, the upstream pump P1 and the downstream pump P2 are the same type of diaphragm pumps, for example. Thus, in the following, an internal structure and an operation of the upstream pump P1 will be described, and the description of an internal structure and an operation of the downstream pump P2 will be omitted. FIG. 3 is a perspective view of the upstream pump P1 in this preferred embodiment. As shown in FIG. 3, the upstream pump P1 includes a first member 110, a second member 120 and a third member 130. FIG. 4 is an exploded view of the upstream pump P1 showing the first member 110, the second member 120 and the third member 130 as being separate from each other. As shown in FIG. 4, the upstream pump P1 in this preferred embodiment further includes a diaphragm 140, an inlet valve 151 and an outlet valve 152.

Figure 5:
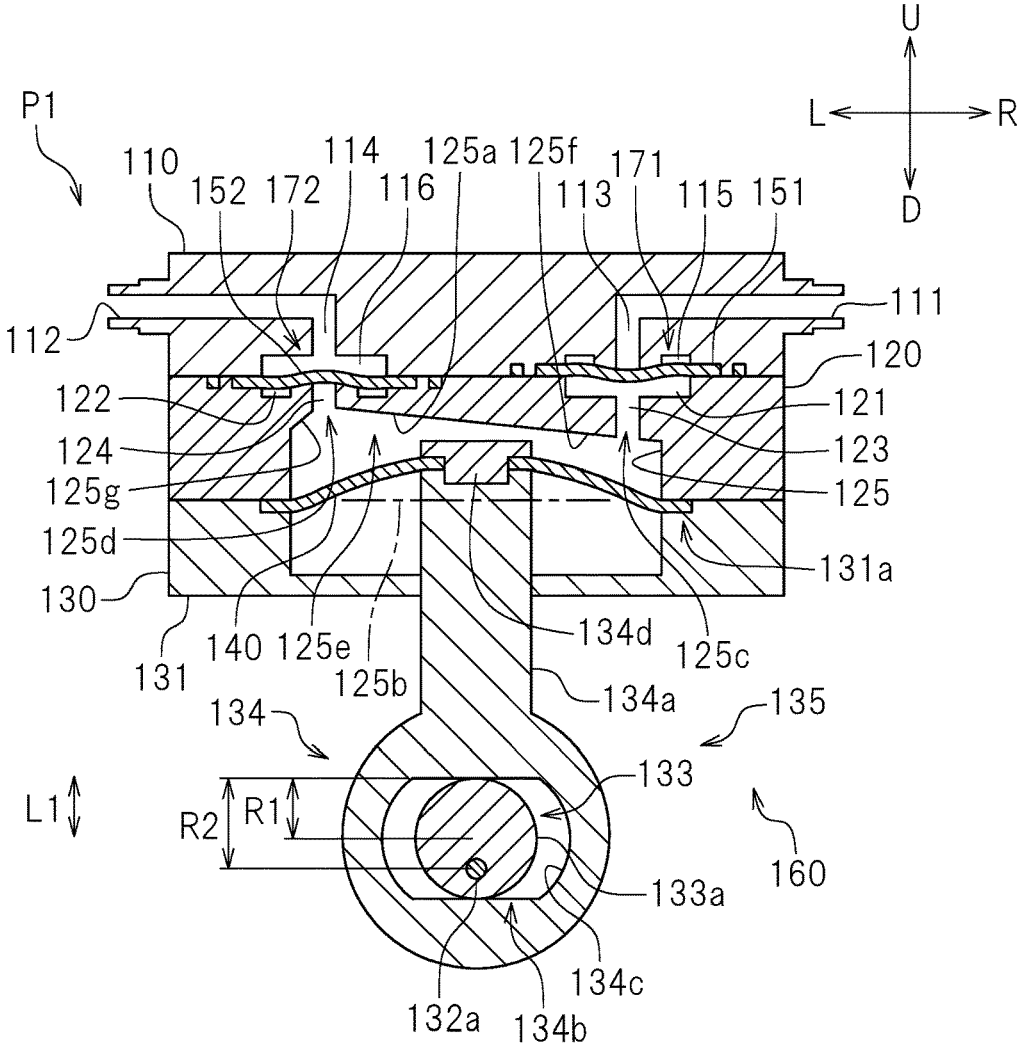
FIG. 5 is a cross-sectional view taken along line V-V in FIG. 3.

The first member 110 is rectangular or substantially rectangular (encompassing square) as seen in a plan view, for example. The first member 110 may be made of, for example, a resin or the like. The first member 110 does not need to have a rectangular or substantially rectangular planar shape, and is not limited to being made of a resin. The first member 110 is provided with an absorption opening 111 and an injection opening 112. The upstream flow path 42*u* is inserted into the absorption opening 111 and the injection opening 112 of the first member 110. In more detail, a portion of the upstream flow path 42*u* closer to the introduction flow path 40 (see FIG. 2) is attached to the absorption opening 111, and a portion of the upstream flow path 42*u* closer to the upstream damper 50 (see FIG. 2) is attached to the injection opening 112. The ink is absorbed into the upstream pump P1 through the absorption opening 111, passes the inside of the upstream pump P1 and is pumped out through the injection opening 112. FIG. 5 is a cross-sectional view taken along line V-V in FIG. 3. As shown in FIG. 5, the first member 110 is provided with a first inlet flow path 113 in communication with the absorption opening 111, and a first outlet flow path 114 in communication with the injection opening 112. The first inlet flow path 113 and the first outlet flow path 114 run through the first member 110 down to a bottom surface of the first member 110. The first member 110 further includes a first inlet chamber 115 and a first outlet chamber 116 provided in the bottom surface thereof. The first inlet chamber 115 is a recessed portion provided in the bottom surface of the first member 110, and is in communication with the first inlet flow path 113. The first outlet chamber 116 is a recessed portion provided in the bottom surface of the first member 110, and is in communication with the first outlet flow path 114.

The second member 120 defines an inlet check mechanism 171 and an outlet check mechanism 172 together with the first member 110, the inlet valve 151 and the outlet valve 152, and defines a pumping mechanism 160 together with the third member 130 and the diaphragm 140. The pumping mechanism 160, the inlet check mechanism 171 and the outlet check mechanism 172 will be described in detail below. The second member 120 is also made of, for example, a resin or the like. As shown in FIG. 5, the second member 120 includes a second inlet chamber 121 and a second outlet chamber 122 provided in a top surface thereof. The second inlet chamber 121 and the second outlet chamber 122 are recessed portions provided in the top surface of the second member 120. A pump chamber 125 is provided in a bottom surface of the second member 120. The pump chamber 125 is a recessed portion provided in the bottom surface of the second member 120. From a bottom surface of the second inlet chamber 121, a second inlet flow path 123 extends downward. The second inlet flow path 123 is a through-hole running from the bottom surface of the second inlet chamber 121 to a top surface 125*a* of the pump chamber 125. Similarly, from a bottom surface of the second outlet chamber 122, a second outlet flow path 124 extends downward. The second outlet flow path 124 is a through-hole running from the bottom surface of the second outlet chamber 122 to the top surface of the pump chamber 125. The pump chamber 125 is provided with three openings, more specifically, an opening 125*b* in a bottom surface thereof (hereinafter, referred to as a "diaphragm attaching opening 125*b*"), an inlet opening 125*c* through which the second inlet flow path 123 passes, and an outlet opening 125*d* through which the second outlet flow path 124 passes.

The inlet valve 151 and the outlet valve 152 are made of, for example, elastically deformable rubber or the like. In this preferred embodiment, the inlet valve 151 and the outlet valve 152 are the same as each other. The inlet valve 151 and the outlet valve 152 may be different from each other. As shown in FIG. 4, the inlet valve 151 includes a valve portion 151*a* and a seal portion 151*b*. In the inlet check mechanism 171, the valve portion 151*a* plays a role of a valve that permits the ink to flow only in an inlet direction into the upstream pump P1 from outside. The seal portion 151*b* is provided in a ring shape enclosing the valve portion 151*a* in the inlet valve 151. In the state where the first member 110 and the second member 120 are joined together, the seal portion 151*b* plays a role of sealing an outer portion of the inlet check mechanism 171. The inlet valve 151 does not need to include the seal portion 151*b*, and another sealing member separate from the inlet valve 151, such as a gasket, an O-ring or the like may seal around the inlet check mechanism 171. The outlet valve 152 has substantially the same structure as that of the inlet valve 151.

The third member 130 holds and secures the diaphragm 140 together with the second member 120, and elastically deforms the diaphragm 140. As shown in FIG. 5, the third member 130 includes a main body 131, a motor 132 (see FIG. 4), an eccentric cam 133, and a connecting rod 134. The main body 131 is made of, for example, a resin or the like. A diaphragm attaching groove 131*a* is provided in the main body 131. The diaphragm 140 is attached to the diaphragm attaching groove 131*a*.

The diaphragm 140 is an elastically deformable sheet-like member. As shown in FIG. 5, in the state where the third member 130 and the second member 120 are joined together, the diaphragm 140 is held and secured by the diaphragm attaching groove 131*a* and the second member 120. The diaphragm 140 in this preferred embodiment has a through-hole at a center thereof. The diaphragm 140 is donut-shaped as seen in a plan view. The details of the diaphragm 140 including the material and the like will be described below.

The connecting rod 134 is secured at a center of the diaphragm 140. In this preferred embodiment, a top end of the connecting rod 134 passes through the central through-hole of the diaphragm 140 and protrudes upward from the diaphragm 140. The top end of the connecting rod 134 includes a securing member 134*d*. The diaphragm 140 is held between the securing member 134*d* and a connecting rod main body 134*a*, and thus is joined with the connecting rod 134. The securing member 134*d* and the connecting rod main body 134*a* are, for example, press-fit to each other. A cam bearing 134*b* is provided in the vicinity of a bottom end of the connecting rod 134. The cam bearing 134*b* is a long hole that is long in the left-right direction. An inner circumferential portion 134*c* of the cam bearing 134*b* is made of a resin of the slide grade. The inner circumferential portion 134*c* may be integrally formed with the connecting rod main body 134*a*, or a separate member attached to the connecting rod main body 134*a*.

As shown in FIG. 5, the eccentric cam 133 is inserted into the cam bearing 134*b*. The eccentric cam 133 is secured to a rotation shaft 132*a* of the motor 132. The eccentric cam 133 has a circular outer circumferential portion 133*a* having a radius R1. The outer circumferential portion 133*a* is made of a resin of the slide grade. Therefore, the inner circumferential portion 134*c* of the cam bearing 134*b* and the outer circumferential portion 133*a* of the eccentric cam 133, both of which are made of a resin of the slide grade, are slidable against each other while being in contact with each other. The eccentric cam 133 is joined with the rotation shaft 132*a* of the motor 132 at a position offset from the center of the outer circumferential portion 133*a*. Along with the rotation of the rotation shaft 132*a*, the eccentric cam 133 rotates. At this point, the eccentric cam 133 rotates while drawing a track of a circle having a radium R2. Along with the rotation of the eccentric cam 133, the connecting rod 134 moves in the up-down direction (first direction) in a reciprocating manner with an amplitude L1 expressed by $L1=2\times(R2-R1)$. The motor 132, the eccentric cam 133 and the connecting rod 134 are included in a diaphragm deformer 135 elastically deforming the diaphragm 140 in the up-down direction.

As shown in FIG. 4, the first member and the third member 130 are joined together by, for example, four screws 117 tightened into four holes 136 respectively. When being joined together, the first member 110 and the third member 130 sandwich the second member 120, the inlet valve 151, the outlet valve 152 and the diaphragm 140. As a result, the second member 120, the inlet valve 151, the outlet valve 152 and the diaphragm 140 are secured. These components are joined together, so that the pumping mechanism 160, the inlet check mechanism 171 and the outlet check mechanism 172 are provided in the upstream pump P1.

The pumping mechanism 160 includes the pump chamber 125, the diaphragm 140, and the diaphragm deformer 135. As shown in FIG. 5, the diaphragm 140 is held between the second member 120 and the third member 130 and thus is attached to cover the diaphragm attaching opening 125*b* of the pump chamber 125. The diaphragm attaching opening 125*b* is covered with the diaphragm 140, so that an inner space 125*e* is provided in the pump chamber 125. The inner space 125*e* is a space enclosed by the pump chamber 125 and the diaphragm 140.

The inlet check mechanism 171 includes the first inlet chamber 115, the second inlet chamber 121, and the inlet valve 151. As shown in FIG. 5, in the state where the first member 110 and the second member 120 are joined together, the first inlet chamber 115 and the second inlet chamber 121 are joined together while facing each other, and thus define an inlet chamber. In the inlet chamber, the inlet valve 151 is secured so as to cover the first inlet flow path 113. Therefore, the inlet valve 151 plays a role of a lid against a pressure from the pump chamber 125, and a liquid is not allowed to move in a direction from the pump chamber 125 toward the absorption opening 111. By contrast, the inlet valve 151 is deformed upon receipt of a pressure from the absorption opening 111, and opens the flow path. Therefore, the liquid is allowed to move in a direction from the absorption opening 111 toward the pump chamber 125. In this manner, the inlet check mechanism 171 permits the movement of the liquid only in the direction from the absorption opening 111 toward the pump chamber 125.

The outlet check mechanism 172 has substantially the same structure as that of the inlet check mechanism 171 except for the direction in which the liquid is allowed to move. The outlet check mechanism 172 allows the liquid to move only in a direction from the pump chamber 125 toward the injection opening 112. The outlet check mechanism 172 includes the first outlet chamber 116, the second outlet chamber 122, and the outlet valve 152. In the state where the first member 110 and the second member 120 are joined together, the first outlet chamber 116 and the second outlet chamber 122 are joined together while facing each other, and thus form an outlet chamber. In the outlet chamber, the outlet valve 152 is secured so as to cover the second outlet flow path 124. The outlet check mechanism 172 permits the liquid to move only in the direction from the pump chamber 125 toward the injection opening 112 by substantially the same principle as that of the inlet check mechanism 171. The inlet check mechanism 171 and the outlet check mechanism 172 allow the liquid to move only in a direction from the absorption opening 111 via the pump chamber 125 toward the injection opening 112.

The pumping mechanism 160 rotates the motor 132 to move the diaphragm 140 in the up-down direction in a reciprocating manner. Along with the reciprocating movement of the diaphragm 140 in the up-down direction, the capacity of the inner space 125*e* is increased or decreased. When the diaphragm 140 is elastically deformed to protrude upward and thus the capacity of the inner space 125*e* is decreased, the outlet check mechanism 172 is opened by the pressure of the ink and thus the ink is pumped out of the pump chamber 125 through the outlet opening 125*d*. The pumped-out ink passes through the second outlet flow path 124 and the first outlet flow path 114 to be injected outside of the upstream pump P1 through the injection opening 112. Next, when the diaphragm 140 is elastically deformed to protrude downward and thus the capacity of the inner space 125*e* is increased, the inlet check mechanism 171 is opened by the negative pressure in the pump chamber 125 and thus the ink is pumped into the pump chamber 125 through the inlet opening 125*c* via the absorption opening 111, the first inlet flow path 113 and the second inlet flow path 123. The upstream pump P1 repeats the above-described motion to pump out the ink in the direction of the arrow shown in FIG. 2. Upon receipt of a signal from the upstream damper 50, the controller 80 controls the timing of the rotation, and the rotation rate, of the motor 132.

Herein, the "liquid pump-out amount" (or injection amount) refers to an amount of liquid (encompassing ink) that can be pumped out by a pump. In general, a capacity-changeable pump such as a diaphragm pump or the like has a liquid pump-out capability thereof decreased if the liquid to be pumped out is contaminated with gas. As described above regarding the upstream pump P1 in this preferred embodiment, the capacity-changeable pump pumps out a liquid by changing the capacity of an inner space of a pump chamber. If the liquid to be pumped out is contaminated with gas, the change in the capacity of the pump chamber is partially absorbed by the change in the volume of the gas, and as a result, the liquid pump-out amount is decreased. The capacity-changeable pump is provided with an assumption that a non-compressible fluid such as water or ink is to be pumped out. If such a non-compressible fluid is contaminated with a compressible fluid such as air, the liquid pump-out capability is decreased by a level corresponding to the change in the volume of the compressible fluid.

In an ink supply system of an inkjet printer, ink is kept at a negative pressure so as not to drip from a nozzle. Therefore, the ink supply system may possibly absorb outer air through the nozzle. This possibility is especially high in an ink supply system that causes the ink to circulate in a circulation flow path, like the ink supply system 30 in this preferred embodiment. In order to avoid this, it is common, in such a circulation ink supply system, to provide an air trap that traps air in the circulation flow path. In the ink supply system 30 in this preferred embodiment also, the air trap 70 is provided in the circulation flow path 42. However, as understood from FIG. 2, in a portion of the downstream flow path 42*d* that is upstream with respect to the air trap 70, air absorbed from the ink head 32 is not removed. Therefore, when air is taken into the ink supply system 30 from the ink head 32, the air flows into the downstream pump P2. In addition, there may be a case where the air removal function of the air trap 70 is not perfect. Therefore, ink containing the air may flow into the upstream pump P1. For these reasons, in the case where a conventional diaphragm is used as each of in the upstream pump P1 and the downstream pump P2, it is highly possible that the liquid pump-out amount is decreased due to the air contaminating the ink to be pumped out. In the case where the pump chamber is contaminated with a certain amount of air or the like, the pump may not be capable of pumping out the ink.

As shown in FIG. 5, in the upstream pump P1 in this preferred embodiment, the outlet opening 125*d* is located at the highest position in the pump chamber 125. In addition, the top surface 125*a* of the pump chamber 125 includes an inclining surface 125*f*. The inclining surface 125*f* is inclined so as to be highest at the outlet opening 125*d* and become gradually lower toward the inlet opening 125*c*.

In the case where the air enters the pump chamber 125, the air enters through the inlet opening 125*c*. The air that has entered the pump chamber 125 has a smaller specific gravity than that of ink, and therefore, is concentrated in a top region in the pump chamber 125. Namely, the air that has entered the pump chamber 125 is concentrated in the vicinity of the outlet opening 125*d*. Such air is immediately discharged from the pump chamber 125 by the driving of the diaphragm pump. Therefore, the air contaminating the ink does not influence the liquid pump-out capability of the diaphragm pump almost at all. As can be seen, the diaphragm pump in this preferred embodiment is able to keep pumping out the ink without having the liquid pump-out capability decreased almost at all even under the condition of use in which the ink is contaminated with air.

In addition, the upstream pump P1 in this preferred embodiment includes the inclining surface 125*f* in the top surface 125*a* of the pump chamber 125. The inclining surface 125*f* extends downward from the outlet opening 125*d*. Therefore, the air that has flown up from the ink in the pump chamber 125 to contact the inclining surface 125*f* is directed toward the outlet opening 125*d* along the inclining surface 125*f*. The upstream pump P1 in this preferred embodiment includes the inclining surface 125*f* in the top surface 125*a* of the pump chamber 125, so that the air contaminating the ink is able to be concentrated in the vicinity of the outlet opening 125*d* efficiently. Therefore, the air contaminating the ink is able to be discharged from the pump chamber 125 efficiently. In FIG. 5, the inclining surface 125*f* is flat, for example. Alternatively, the inclining surface 125*f* may be curved.

The top surface 125*a* of the pump chamber 125 includes a second inclining surface 125*g* opposite to the inclining surface 125*f*, with the outlet opening 125*d* being sandwiched between the inclining surface 125*f* and the second inclining surface 125*g*. In this manner, the top surface 125*a* of the pump chamber 125 may include a plurality of inclining surfaces. The second inclining surface 125*g* guides, toward the outlet opening 125*d*, the air that has reached a portion to the left of the outlet opening 125*d*. In the case where the top surface 125*a* includes such a plurality of inclining surfaces, the outlet opening 125*d* does not need to be formed at one end of the pump chamber 125, and may be provided at a center of the top surface 125*a* or the vicinity of the center, for example.

The inlet opening 125*c* is provided in the vicinity of a right end of the inclining surface 125*f*. The inlet opening 125*c* is provided at an intermediate position of the inclining surface 125*f*. The air enters the pump chamber 125 through the inlet opening 125*c*. Since the inlet opening 125*c* is provided in the inclining surface 125*f*, the air is guided to the vicinity of the outlet opening 125*d* more efficiently.

As described above, the upstream pump P1 in this preferred embodiment includes the outlet opening 125*d*, through which the liquid may be discharged from the pump chamber 125, at the highest position in the pump chamber 125, and includes the inclining surface 125*f* guiding the air toward the outlet opening 125*d*. With such a structure, the air that has entered the pump chamber 125 is able to be discharged quickly. In addition, the inlet opening 125*c*, through which the liquid may enter the pump chamber 125, is provided in the inclining surface 125*f*. With such a structure, the air is able to be discharged more efficiently. Since the air that has entered the pump chamber 125 is discharged quickly, the liquid pump-out capability of the pump is not spoiled almost at all.

A diaphragm pump has other factors that decrease the liquid pump-out capability thereof, in addition to the entrance of the air into the pump chamber. One of the factors is deterioration of the diaphragm. The diaphragm is structured to have an appropriate level of elasticity and rigidity to pump out a liquid. The diaphragm pump changes the capacity of the pump chamber by elastic deformation of the diaphragm. Therefore, the elasticity of the diaphragm is necessary. If the rigidity of the diaphragm is low, the diaphragm is pressed by the pressure of the liquid to be pumped out and thus is expanded, and the liquid pump-out amount is decreased by the expansion. In order to avoid this, the diaphragm is adjusted in advance to have an appropriate level of elasticity and rigidity.

The rigidity of a diaphragm is provided by, for example, coating a surface of the diaphragm. The coating is made of, for example, a fluorine resin or the like. In the case where the surface of the diaphragm is coated with a fluorine resin, the chemical resistance of the diaphragm is improved, so that the diaphragm is usable for various types of chemicals and is also provided with rigidity. Therefore, this method is generally used. However, a diaphragm pump including such a diaphragm has the rigidity of the coated surface weakened while being used, due to the elastic deformation of the diaphragm. The liquid pump-out amount of the diaphragm pump is rapidly decreased from a certain point.

Figure 6:
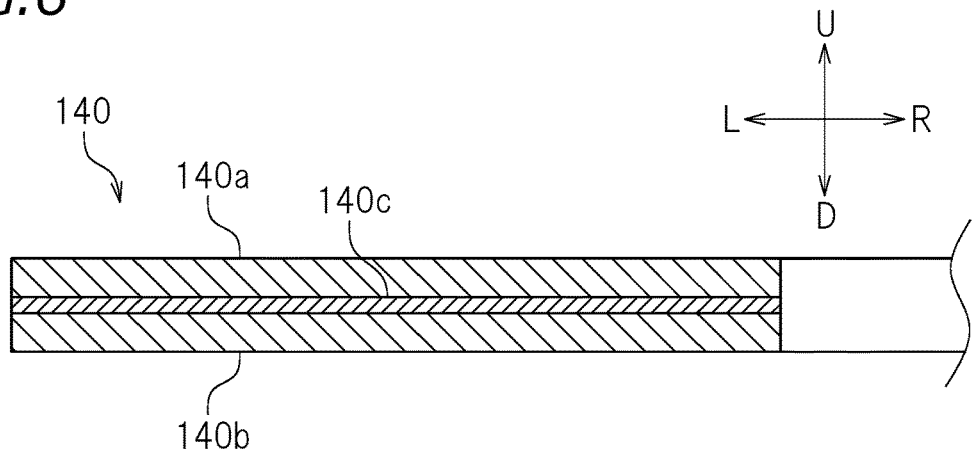
FIG. 6 is a vertical cross-sectional view of a diaphragm.

FIG. 6 is a schematic view showing a vertical cross-sectional view of the diaphragm 140. As shown in FIG. 6, the diaphragm 140 in this preferred embodiment includes three donut-shaped sheets joined together. In more detail, the diaphragm 140 includes a first sheet 140*a*, a second sheet 140*b*, and a reinforcing sheet 140*c*. The first sheet 140*a* and the second sheet 140*b* are the same as each other. The material of the first sheet 140*a* and the second sheet 140*b* is, for example, elastically deformable rubber. The first sheet 140*a* and the second sheet 140*b* define a top surface and a bottom surface of the diaphragm 140. In this preferred embodiment, the first sheet 140*a* defines the top surface of the diaphragm 140, and the second sheet 140*b* defines the bottom surface of the diaphragm 140. The first sheet 140*a* and the second sheet 140*b* may be positionally replaced with each other. The diaphragm 140 is symmetrical in the up-down direction. The diaphragm 140 may be configured such that the top portion and the bottom portion are distinguishable from each other. The first sheet 140*a* and the second sheet 140*b* may be different from each other.

The reinforcing sheet 140*c* is sandwiched between the first sheet 140*a* and the second sheet 140*b*. The reinforcing sheet 140*c* provides the diaphragm 140 with rigidity. The reinforcing sheet 140*c* is made of, for example, rigid cloth. The reinforcing sheet 140*c* does not need to be made of cloth, and may be made of, for example, a thin metal plate or the like. The reinforcing sheet 140*c* suppresses or prevents the diaphragm 140 from expanding due to the pressure of the liquid. Unlike coating, the reinforcing sheet 140*c* does not have the rigidity changed easily even if the diaphragm 140 is deformed in repetition, and thus is durable against aged deterioration. The upstream pump P1 in this preferred embodiment includes the diaphragm 140 including the reinforcing sheet 140*c* and thus is able to maintain the liquid pump-out amount thereof even after being used for a long time.

As shown in FIG. 5, the upstream pump P1 in this preferred embodiment is structured such that the diaphragm 140 does not contact the top surface 125*a* of the pump chamber 125. FIG. 5 shows a state where the diaphragm 140 is closest to the top surface 125*a* of the pump chamber 125. Even in the state shown in FIG. 5, there is a gap between the diaphragm 140 and the top surface 125*a* of the pump chamber 125. Since the diaphragm 140 does not contact the top surface 125*a* of the pump chamber 125 while moving in the up-down direction in a reciprocating manner, the diaphragm 140 is able to be presented from being abraded or damaged. Since the diaphragm 140 is able to be prevented from being abraded or damaged, the liquid pump-out amount is prevented from being decreased due to aged deterioration.

A secondary effect of the configuration in which the diaphragm 140 and the top surface 125*a* of the pump chamber 125 do not contact each other is that the cost of the diaphragm pump is decreased. Since the diaphragm 140 does not contact any component while moving in a reciprocating manner, the diaphragm deformer 135 (the motor 132, the eccentric cam 133 and the connecting rod 134) is not required to have a high mechanical strength. Usually, a mechanism that converts the rotation motion of the motor 132 into the reciprocating motion of the connecting rod 134 uses a bearing or the like. The upstream pump P1 in this preferred embodiment uses a resin of the slide grade. A rotation-transmitting portion that is made of a resin does not have a high mechanical strength but costs low. Use of such a rotation-transmission portion made of a resin, instead of a bearing or the like, can reduce the cost of the diaphragm pump.

As described above, in the diaphragm pump in this preferred embodiment, the outlet opening 125*d* in communication with the injection opening 112 is provided at the highest position in the pump chamber 125, so that the air concentrated to such a position is discharged immediately. The top surface 125*a* of the pump chamber 125 includes the inclining surface 125*f* extending downward from the outlet opening 125*d*, so that the air is able to be concentrated in the vicinity of the outlet opening 125*d* efficiently. The inlet opening 125*c* in communication with the absorption opening 111 is provided in the inclining surface 125*f*, so that the air entering the pump chamber 125 through the inlet opening 125*c* is concentrated in the vicinity of the outlet opening 125*d* more efficiently. Even if the air enters the pump chamber 125, the diaphragm pump in this preferred embodiment is able to discharge the air immediately. Therefore, the liquid pump-out amount is not decreased almost at all due to the entrance of the air.

The diaphragm pump in this preferred embodiment includes the diaphragm 140 that includes the first sheet 140*a* and the second sheet 140*b* both made of rubber and the reinforcing sheet 140*c* sandwiched between the first sheet 140*a* and the second sheet 140*b*. With such a structure, the decrease in the liquid pump-out amount, which would otherwise be caused by aged deterioration, is prevented. Owing to the reinforcing sheet 140*c*, the diaphragm 140 in this preferred embodiment does not have the rigidity thereof changed much, and does not much decrease the liquid pump-out amount of the diaphragm pump, even after being used for a long time.

The diaphragm pump in this preferred embodiment does not allow the diaphragm 140 to contact the pump chamber 125. Therefore, the diaphragm 140 is not easily abraded or damaged. Therefore, the decrease in the liquid pump-out amount, which would otherwise be caused by the abrasion or damage of the diaphragm 140, is prevented. Since the diaphragm 140 does not contact the pump chamber 125, the diaphragm deformer 135 does not need to have a high mechanical strength and thus is provided at low cost. In this preferred embodiment, the slidable portion of the diaphragm deformer 135 is made of a resin to decrease the cost.

The above-described diaphragm pump is especially effective for a circulation ink supply system and also for an inkjet printer including such an ink supply system. In a circulation ink supply system, ink is circulated in order to prevent a pigment or the like contained in the ink from being precipitated. However, this causes the ink supply system to easily absorb air from the ink head. The above-described diaphragm pump, even if the air enters the pump chamber, is able to keep pumping out the ink without being influenced almost at all by the air.

Preferred embodiments of the present invention have been described. The diaphragm pumps, the ink supply systems including the diaphragm pumps, and the inkjet printers including the ink supply systems according to preferred embodiments of the present invention are not limited to those in the above-described preferred embodiment.

For example, the diaphragm pumps according to preferred embodiments of the present invention are not limited to being used for ink supply systems of inkjet printers, and are usable for any of various other uses. The ink supply systems according to preferred embodiments of the present invention are not limited to being mounted on inkjet printers, and are applicable to any devices that inject ink, for example, three-dimensional printers of a powder-curing type.

In the above-described preferred embodiments, the inlet opening through which a liquid may flow into the pump chamber and the outlet opening through which the liquid may flow out of the pump chamber are located in a horizontal direction. The positional arrangement of the inlet opening and the outlet opening is not limited to this. For example, the inlet opening may be provided at a bottom position, whereas the outlet opening may be provided at a top position in the pump chamber. The position and the orientation of the diaphragm attaching opening are not limited to those in the above-described preferred embodiments. The diaphragm attaching opening may be, for example, vertical. The diaphragm attaching opening does not need to face the top surface of the pump chamber. There is no limitation on the positional arrangement of the inlet opening, the outlet opening and the diaphragm attaching opening in the pump chamber except that the outlet opening is located at the highest position.

In the above-described preferred embodiments, the diaphragm deformer includes the connecting rod movable in a reciprocating manner. The diaphragm deformer is not limited to being such a mechanism. The diaphragm deformer may be any mechanism that elastically deforms the diaphragm. For example, the diaphragm may be elastically deformed by the cam itself. The cam mechanism may not be needed in order to convert the rotation motion into the reciprocating motion. For example, the mechanism that converts the rotation motion into the reciprocating motion may be a crank mechanism or the like.

In the above-described preferred embodiments, the diaphragm pump includes the check mechanism both on the inlet side and the outlet side. The check mechanism may be provided outside the pump. For example, in the circulation flow path 42 shown in FIG. 2, check valves may be provided upstream and downstream with respect to the upstream pump P1 and upstream and downstream with respect to the downstream pump P2. Even with such a structure, the ink supply system 30 is able to operate in substantially the same manner. The check mechanism is not limited to having the above-described structure. Any of various check mechanisms, for example, a check mechanism including a mechanical valve openable only to one side, is usable.

The materials of the components of the diaphragm pump are not limited to those described above. For example, the first member, the second member and the third member may be made of a metal material, for example, an aluminum alloy or the like. The first sheet and the second sheet of the diaphragm do not need to be made of rubber, and may be made of any of various other elastic materials. The reinforcing sheet of the diaphragm does not need to be made of cloth or a metal material, and may be made of, for example, a resin or the like.

In the above-described preferred embodiments, the diaphragm pump includes the first member, the second member and the third member, and also includes an elastic diaphragm or the like held between these members. The diaphragm pump is not limited to having such a structure. There is no limitation on the specific structure of the components of the diaphragm pump.

The positional arrangement of components of the circulation flow path of the ink supply system is not limited to that described in the above-described preferred embodiments. The positional arrangement of the components of the circulation flow path may be changed appropriately, and any component may be added appropriately. The ink supply systems according to preferred embodiments of the present invention are not limited to including a circulation flow path in which the ink circulates. For example, the ink supply systems may be of a system in which the ink is supplied linearly from the ink tank to the ink head. The diaphragm pumps according to preferred embodiments of the present invention are applicable to any known type of ink supply system including a pump.

The ink supply systems according to preferred embodiments of the present invention may inject ink by any of various continuous systems such as a binary deflection system, a continuous deflection system and the like, or any of various on-demand systems such as a piezo driving system, a thermal system and the like. There is no limitation on the ink injection system.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A diaphragm pump, comprising:

a pump chamber that is box-shaped and includes at least an inlet opening allowing a liquid to flow into the pump chamber therethrough from outside, an outlet opening allowing the liquid to flow out of the pump chamber therethrough, a diaphragm attaching opening, and an inner space;

a diaphragm made of an elastically deformable material and provided in the pump chamber to cover the diaphragm attaching opening; and a diaphragm deformer provided outside the pump chamber and coupled with the diaphragm, the diaphragm deformer elastically deforming the diaphragm to change a capacity of the inner space; wherein the outlet opening is located at a highest position in the inner space of the pump chamber, the pump chamber further includes a top surface provided with the outlet opening, the top surface includes an inclining surface extending downward and laterally from the outlet opening, the inlet opening is provided in the inclining surface, and the inclining surface extends continuously downward and laterally from the outlet opening to at least the inlet opening to decrease a height of the top surface within the pump chamber.

2. The diaphragm pump according to claim 1, wherein the pump chamber includes a first inner wall facing the diaphragm; and the diaphragm deformer elastically deforms the diaphragm such that a gap is provided between the diaphragm and the first inner wall even in a state where the diaphragm and the first inner wall are closest to each other.

3. The diaphragm pump according to claim 1, wherein the diaphragm deformer includes:

a motor including a rotation shaft;

a cam secured to the rotation shaft and being rotatable together with the rotation shaft; and a connecting rod movable in a reciprocating manner in a first direction along with the rotation of the cam; and the connecting rod is secured to the diaphragm and elastically deforms the diaphragm in the first direction.

4. The diaphragm pump according to claim 3, wherein the cam includes an outer circumferential portion made of a resin; and the connecting rod includes a cam bearing that includes an inner circumferential portion in contact with the outer circumferential portion of the cam, the inner circumferential portion being made of a resin.

5. The diaphragm pump according to claim 1, wherein the diaphragm includes a first sheet made of an elastic material, a second sheet made of an elastic material, and a reinforcing member sandwiched between the first sheet and the second sheet.

6. An ink supply system, comprising:

an ink tank storing ink;

an ink head injecting the ink;

an introduction flow path including a first end connected with the ink tank and a second end;

an upstream flow path including a first end connected with the second end of the introduction flow path and a second end connected with the ink head;

a downstream flow path including a first end connected with the ink head and a second end connected with the second end of the introduction flow path and the first end of the upstream flow path;

an upstream pump provided in the upstream flow path; and a downstream pump provided in the downstream flow path; wherein the upstream pump and the downstream pump are each defined by the diaphragm pump according to claim 1.

7. An inkjet printer, comprising the ink supply system according to claim 6.

8. The diaphragm pump according to claim 1, wherein the inclining surface is a flat surface.

9. The diaphragm pump according to claim 1, wherein the diaphragm deformer includes a connecting rod that is secured to the diaphragm and is movable in a reciprocating manner in a first direction, an axis of the connecting rod passes through a central region of the inner space of the pump chamber in a second direction that is perpendicular to the first direction, the inlet opening is provided at one side of the connecting rod in the second direction, and the outlet opening is provided at another side of the connecting rod in the second direction.

10. The diaphragm pump according to claim 9, wherein the inlet opening is provided at an edge of the inclining surface in the second direction, and the outlet opening is provided at another edge of the inclining surface in the second direction.

* * * * *